United States Patent [19]

Stenberg

[11] 4,255,901

[45] Mar. 17, 1981

[54] WINDOW DEVICE

[76] Inventor: Sven-Eric Stenberg, Gimlevägen 21, Danderyd, Sweden

[21] Appl. No.: 945,816

[22] Filed: Sep. 26, 1978

[30] Foreign Application Priority Data

Sep. 29, 1977 [SE] Sweden ..... 77108751

[51] Int. Cl.[3] ..... E05D 7/00

[52] U.S. Cl. ..... 49/402; 49/67; 49/505

[58] Field of Search ..... 49/505, 67, 489, 478, 49/402; 160/374, 372, 377; 52/656, 202, 632

[56] References Cited

U.S. PATENT DOCUMENTS

| | | | |
|---|---|---|---|
| 2,093,727 | 9/1937 | Julien | 49/67 X |
| 2,396,560 | 3/1946 | Dion | 160/374 |
| 2,800,957 | 7/1957 | Giglio et al. | 160/374 |
| 2,840,161 | 6/1958 | Alexander et al. | 160/377 |
| 3,314,196 | 4/1967 | Betz et al. | 49/478 X |
| 3,553,891 | 1/1971 | Casebolt et al. | 49/505 |
| 3,654,734 | 4/1972 | Lehman | 49/505 |

*Primary Examiner*—Philip C. Kannan

[57] ABSTRACT

An inner window for the thermal and acoustic insulation of existing windows comprises an adjustable frame having hollow sections connected by elements inserted therein and spacer sections covering the connecting elements, a corresponding pane, and means for securing the pane to the frame in a sealing relation. The frame sections are all of similar cross-sectional dimensional for a uniform frame contour.

6 Claims, 3 Drawing Figures

FIG. 1
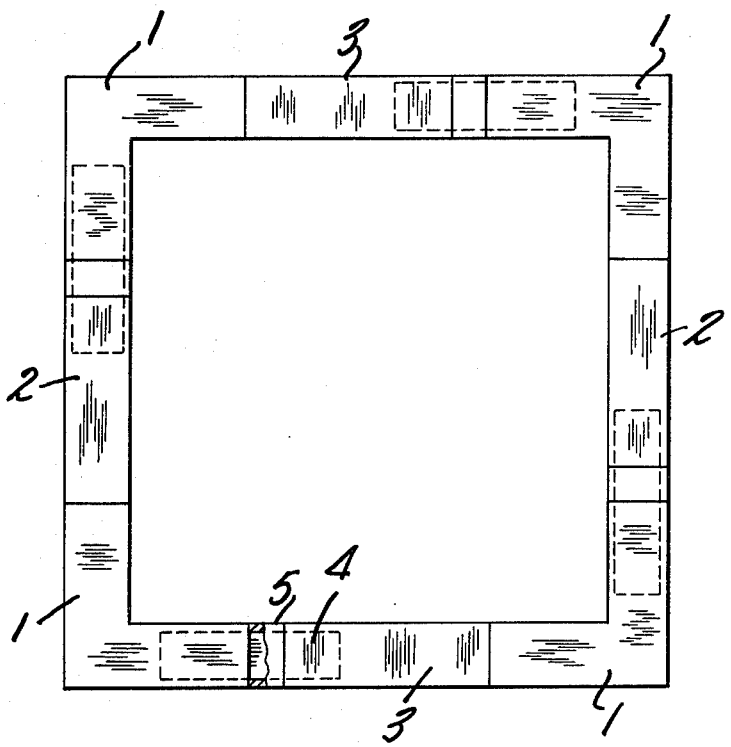
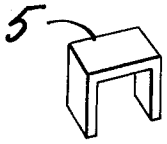
FIG. 2
FIG. 3
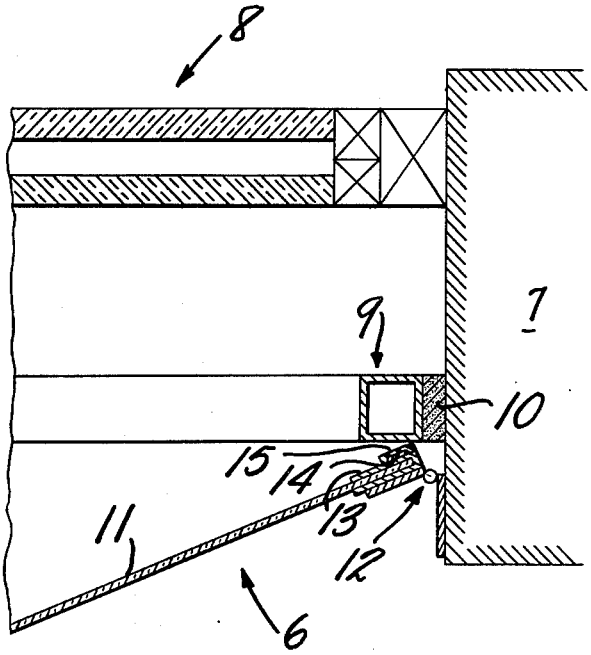

WINDOW DEVICE

BACKGROUND OF THE INVENTION

This invention relates to a window device and is primarily intended for the thermal and acoustic insulation of windows already existing in buildings. A previously known method of thermal and acoustic insulation of existing windows is to construct an extra inner window and seal it with sealing strips. However, this construction is costly and requires comparatively extensive alteration to the existing wall and window structure.

SUMMARY OF THE INVENTION

The purpose of this invention is to provide a window which in its size and shape can easily be adapted to an existing wall opening or window design. The invention is intended to be used primarily as an inner window for the thermal and acoustic insulation of existing windows. According to the invention, the frame of the add-on window is constructed of separable straight and angled sections of matched cross-sectional dimension which are designed to be connected to each other, and the window pane consists of a transparent sheet secured to the frame in a sealing relation. The sections of the window frame are hollow and are connected to each other by inserted elements so that they form a window frame adapted to the shape of the window opening.

In a preferred embodiment of the invention, the connecting elements are covered by spacer sections fitted over the exposed lengths and dimensioned so that the window frame has a uniform cross-section all the way around, which appreciably facilitates sealing. By the use of the spacer sections, the frame can be installed securely without the need of nails, screws or the like. Thus the sides of the frame can be adjusted for exact adaption to the dimensions of the window opening, and the frame will retain its shape even after removal of the mechanism for installing the frame. The pane is attached to the frame or the window jamb by means of a hinge and is sealed with sealing strips. When a metal frame is used, the sealing strips may include a magnetic element.

BRIEF DESCRIPTION OF THE DRAWINGS

The invention is described in greater detail below with reference to the drawings of which FIG. 1 shows a partly schematic view of the window frame constructed of sections and connecting elements, FIG. 2 a spacer element for the rectangular sections of the window frame, and FIG. 3 a horizontal cross-sectional view showing part of an existing window and part of the inner window of the invention mounted in the window opening (the pane of the inner window is shown in a partly pivoted position, though it will be understood that in use the pane is positioned in sealing relation against the frame).

DESCRIPTION OF THE PREFERRED EMBODIMENT

The window frame shown in FIG. 1 consists of four corner sections 1 and paired intermediate sections 2 and 3 connected to them. The rectangular cross-sectional dimensions of all the sections are matched, and connection is achieved with the aid of connecting elements 4 (typically indicated at one location in FIG. 1) that are inserted into the sections. Where the corner and intermediate sections are spaced apart to adapt the frame to the contour of the opening, spacer sections 5 are designed to snap onto the exposed lengths of the connecting elements in order to equalize the length of the frame sides. The spacers are of identical cross-sectional dimensions as the other sections. FIG. 2 shows a typical spacer section of rectangular cross-section used for the frame in FIG. 1. Since the sections are of similar cross-section, no edge is formed in the connecting zones. This facilitates sealing of the inner window with improved acoustic and thermal insulation as a result.

In FIG. 3 the inner window 6 of the invention is shown positioned against the jamb 7 at a suitable distance from the existing window 8. Owing to the adjustable design, the size of the frame can be adapted fairly accurately to the window opening. In order to improve its insulation properties, the outer edge of the frame 9 is surrounded with a sealing strip 10 of resilient material. Sealing the frame against the jamb can be further improved if the frame is clamped in place.

Since the connecting elements permit the sides of the frame to be extended, effective installation of the frame in the opening can be achieved by pressing two opposite sides of the frame against the jamb with the aid of a suitable tensioning device. The sealing strip 10 fitted around the outer edge of the frame 9 yields slightly under the tension. A space of a certain size is formed between the corner sections 1 and the intermediate sections 2 or 3 on opposite sides of the frame. Spacer elements 5 are inserted to fit between the respective corner sections and intermediate sections, following which the tensioning device is removed. Due to the spacer elements, the length of the frame is maintained even after removal of the tensioning device. Tensioning of the other two opposite frame sides is then carried out in a similar manner. Mounting of the frame in this manner provides effective thermal and acoustic insulation without causing any damage to the window opening.

FIG. 3 also shows the corresponding pane 11 of the inner window 6 pivotably mounted in the opening by means of a hinge 12. A molding 13 is framed around the edge of the pane, and the hinge is secured between the molding and the jamb. Mounting of the pane is accomplished so that the pane is aligned in sealing abutment with the frame and a sealing strip is provided therebetween. In order to increase the contact pressure between the pane and a metal frame, and thereby increase the effectiveness of the seal, the molding 13 is provided with a magnetic strip 14 along the perimeter of the molding abutting the frame. The magnetic strip is suitably carried in a sleeve 15 fixed to the molding 13 or arranged as in integral part thereof.

It will be understood that the above described embodiment is merely exemplary and that those skilled in the art may make many variations and modifications without departing from the spirit and scope of the invention. All such modifications and variations are intended to be within the scope of the invention as defined in the appended claims.

I claim:

1. A window device comprising a frame and a corresponding pane, said frame having hollow separable sections of matched cross-sectional dimension, connecting elements inserted in the sections for aligning the sections together, means for adjusting the height and width of said frame for fitting said frame within a receiving space, and means for securing the pane in sealing relation with respect to the frame when said window device is mounted within said receiving space, including means for spacing apart said hollow sections comprising spacer sections adapted to be positioned between adjacent hollow sections and to fit over exposed lengths of the connecting elements between the hollow sections, said spacer sections being of matched cross-sectional dimension with the hollow sections.

2. The window device of claim 1 wherein the securing means comprises hinge means for pivotably mounting the pane in aligned abutment with the frame and sealing means between the pane and the frame along the perimeter of abutment.

3. The window device of claim 2 wherein the sections of the frame are metal, and the sealing means includes a magnetic strip.

4. In combination with a window framed in a jamb, a device for thermal and acoustic insulation of the window comprising a frame, a corresponding pane, and means for securing the pane in sealing relation with respect to the frame, said frame having: (a) hollow corner and intermediate sections of matched rectangular cross-sectional dimension; (b) connecting elements inserted in the sections for aligning the corner and intermediate sections together, wherein adjacent sections may be moved together or apart to vary the height and width of said frame; and (c) spacer sections adapted to be positioned between adjacent hollow sections and to fit over exposed lengths of the connecting elements between the corner and intermediate sections, said spacer sections being of matched cross-sectional dimension with the other sections, thereby to make the height and width of said frame adjustable to the contour of the jamb.

5. The combination of claim 4 wherein the securing means of the insulating device comprises a molding framing the pane, a hinge secured to the molding and the jamb for pivotably mounting the pane in aligned abutment with the frame, and sealing means on the molding for sealing the perimeter of abutment between the pane and the frame.

6. The combination of claim 5 wherein the sections of the frame are metal, and the sealing means includes a magnetic strip.

* * * * *